US010215508B2

(12) United States Patent
Somhorst et al.

(10) Patent No.: US 10,215,508 B2
(45) Date of Patent: Feb. 26, 2019

(54) HEADER TANK RIB DESIGN FOR A HEAT EXCHANGER

(71) Applicant: Halla Visteon Climate Control Corp., Daejeon (KR)

(72) Inventors: Leo Somhorst, Chislehurst (GB); Richard Steven Armsden, Essex (GB); Keith Roland Wilkins, Essex (GB); Ryan Platt, Essex (GB)

(73) Assignee: HANON SYSTEMS, Daejeon-si (KR)

( * ) Notice: Subject to any disclaimer, the term of this patent is extended or adjusted under 35 U.S.C. 154(b) by 496 days.

(21) Appl. No.: 14/750,001

(22) Filed: Jun. 25, 2015

(65) Prior Publication Data

US 2016/0010931 A1 Jan. 14, 2016

Related U.S. Application Data

(60) Provisional application No. 62/023,397, filed on Jul. 11, 2014.

(51) Int. Cl.
*F28F 9/02* (2006.01)

(52) U.S. Cl.
CPC ..... *F28F 9/02* (2013.01); *F28F 9/0224* (2013.01); *F28F 2225/08* (2013.01)

(58) Field of Classification Search
CPC ..... F28F 9/02; F28F 2225/08; F28F 9/0224; F28F 2009/0292; F28F 2225/02
See application file for complete search history.

(56) References Cited

U.S. PATENT DOCUMENTS

| | | | | |
|---|---|---|---|---|
| 4,331,201 | A | 5/1982 | Hesse | |
| 4,971,145 | A | 11/1990 | Lyon | |
| 6,082,446 | A * | 7/2000 | Ahaus | F28F 9/0226 165/149 |
| 7,661,415 | B2 * | 2/2010 | Nakamura | F28D 9/0025 123/568.12 |
| 2002/0148599 | A1 * | 10/2002 | Kaemmler | F01P 11/04 165/133 |

(Continued)

FOREIGN PATENT DOCUMENTS

| | | | |
|---|---|---|---|
| DE | 102008028263 | A1 | 1/2009 |
| DE | 112008002905 | T5 | 12/2010 |

(Continued)

*Primary Examiner* — Jianying C Atkisson
*Assistant Examiner* — Jose O Class-Quinones
(74) *Attorney, Agent, or Firm* — Shumaker, Loop & Kendrick, LLP; James D. Miller

(57) ABSTRACT

A tank for a heat exchanger includes a casing including a substantially planar header opening formed therein and a foot disposed around a perimeter of the header opening. The foot forms an outwardly extending flange from which a pair of oppositely arranged walls extend, the oppositely arranged walls forming an arcuate shape including a spine extending along an apex of the arcuate shape. The oppositely arranged walls each have a corrugated profile adjacent the foot due to the presence of outwardly projecting ribs formed in the oppositely arranged walls. Each of the ribs extend lengthwise from the foot toward the spine, wherein a distal end of each of the ribs is formed adjacent a neutral stress portion of the casing which undergoes a minimal stress when the casing is subjected to an internal pressure from a fluid flowing there through.

17 Claims, 3 Drawing Sheets

(56) References Cited

U.S. PATENT DOCUMENTS

| | | | | |
|---|---|---|---|---|
| 2007/0267184 | A1* | 11/2007 | Freitag | F28F 9/0226 165/159 |
| 2014/0069938 | A1 | 3/2014 | Maloney et al. | |

FOREIGN PATENT DOCUMENTS

| | | | |
|---|---|---|---|
| EP | 2085737 | A1 | 8/2009 |
| EP | 2161530 | A2 | 3/2010 |
| JP | 5576207 | | 6/1980 |
| JP | 61141593 | | 9/1986 |
| JP | 62112492 | | 7/1987 |

* cited by examiner

HEADER TANK RIB DESIGN FOR A HEAT EXCHANGER

CROSS-REFERENCE TO RELATED APPLICATION

This application claims priority to U.S. Provisional Patent Application Ser. No. 62/023,397, filed Jul. 11, 2014, the entire disclosure of which is hereby incorporated herein by reference.

FIELD OF THE INVENTION

The invention relates to a heat exchanger, and more specifically to a casing for a heat exchanger tank including a plurality of corrugations formed in opposing sides thereof.

BACKGROUND OF THE INVENTION

Heat exchangers typically include a centralized plurality of heat exchanger tubes or passageways connected at each respective end thereof to one of an inlet tank and an outlet tank. The inlet tank and the outlet tank each typically include one substantially planar surface that acts as a header for receiving the heat exchanger tubes therein. The header of each of the tanks is then coupled to a casing of the tanks that aids in distributing or collecting a fluid flowing through the heat exchanger tubes. The casing of each of the inlet tank and the outlet tank often includes a conduit connected to a portion of the casing having an expanding wall geometry used to cover a periphery of the header, wherein the header and the casing cooperate to define a hollow interior chamber through which the fluid passes during use of the heat exchanger.

Internal pressures experienced within either of the inlet tank or the outlet tank may cause a bending moment to form within each of the casings, thereby dividing the casing into portions undergoing compressive stresses and portions undergoing tensile stresses. FIGS. 1 and 2 illustrate a casing 1 according to the prior art. The casing 1 includes a pair of neutral stress lines A extending along a length thereof. The neutral stress lines A may be formed symmetrically on each side of the casing 1, hence only one of the neutral stress lines A is pictured in FIG. 1. Each of the neutral stress lines A corresponds to a portion of the casing 1 wherein stresses caused by such a bending moment are minimized due to a transition from the compressive stresses to the tensile stresses experienced within the casing 1. The portion of the casing 1 disposed between the two neutral stress lines A and corresponding to a spine of the casing 1 undergoes compressive stresses while each portion of the casing 1 formed beneath the neutral stress lines A undergoes tensile stresses.

The prior art casing 1 further includes a plurality of ribs 2 formed on an exterior surface thereof to further strengthen the casing 1 to avoid deformation. The casing 1 illustrated in FIGS. 1 and 2 includes an outwardly extending foot 3 formed around a periphery thereof having a plurality of substantially semi-circular crimp joints 4 protruding therefrom. The crimp joints 4 are included on the foot 3 of the casing 1 for coupling a ribbon crimp strip 5 of an associated header (not shown) to the casing 1. As shown in FIG. 2, the ribbon crimp strip 5 is a corrugated strip of material including recessed portions 6 configured to be disposed on the foot 3 of the casing 1 and projecting portions 7 configured to extend around and receive the substantially semi-circular crimp joints 4. Accordingly, the header may be coupled to the casing 1 by securing the ribbon crimp strip 5 of the header to the foot 3 of the casing 1 about a perimeter thereof.

Each of the ribs 2 extends from one of the semi-circular crimp joints 4 to an oppositely arranged one of the crimp joints 4, causing each of the ribs 2 to be substantially arcuate in shape. The ribs 2 project away from an exterior surface of the casing with a substantially rectangular cross-section that extends about the entire arcuate shape of each of the ribs 2, as best shown in FIG. 2. The rectangular cross-section of each of the ribs 2 creates several sharp edges and sudden transitions from one portion of the exterior surface of the casing 1 to an adjoining portion.

The ribs 2 illustrated in FIG. 1 are spaced apart from each other equally to cause the ribs 2 to have a constant frequency of occurrence in the longitudinal direction of the casing 1. Such an arrangement ensures that the casing 1 is reinforced along any and all potential problem areas. In contrast, FIG. 3 illustrates a casing 1' that is identical to the casing 1 illustrated in FIGS. 1 and 2 except the casing 1' includes the ribs 2 formed on an exterior surface thereof only along those portions of the casing 1' undergoing the greatest amount of internal stresses. Accordingly, the casing 1' of FIG. 3 reduces the amount of material used to form the casing 1' while also addressing the issue of localized stresses formed therein.

Unfortunately, one issue associated with the use of the ribs 2 illustrated in FIGS. 1-3 is the ribs 2 are not formed on the exterior surface of the casings 1, 1' in a manner that accounts for the variation of the stress encountered along different portions of each of the ribs 2 as they extend in an arcuate shape. Specifically, the ribs 2 tend to extend around an entirety of the exterior surface of the casing 1 wherein portions of the casing 1 experiencing a relatively low stress such as regions adjacent each of the neutral stress lines A are unnecessarily reinforced. Thus, excess material is used in forming each of the casings 1, 1', thereby adding weight, cost, and complexity to the formation of the casings 1, 1'. Furthermore, if additional reinforcing is desired beyond that illustrated in FIGS. 1-3, each of the ribs 2 used to reinforce the casings 1, 1' may need an enlarged cross-sectional shape to account for the additional degree of reinforcement. Such an increase in the size of the ribs 2 may undesirably increase a package size of the casings 1, 1', which in turn may necessitate a rearrangement or modification of other components adjacent the casings 1, 1' when one of the casings 1, 1' is installed within a vehicle or other apparatus where a packaging space is limited.

One other issue encountered by the use of the ribs 2 shown in FIGS. 1-3 is the substantially rectangular cross-sectional shape of each of the ribs 2 may lead to local stress raisers within the casings 1, 1' caused by the sudden change in geometry from the exterior surface of each of the casings 1, 1' to the perpendicularly projecting ribs 2 formed thereon. The rectangular cross-sectional shape of the ribs 2 may also cause a molding operation used to form the casings 1, 1' to take longer than would a molding of a casing having a more continuous exterior profile, as the molding material typically takes longer to reach the sharp edges and corners formed between such features during the molding process.

One other prior art solution includes the addition of cross-webbing extending between adjacent ones of the ribs to further reinforce and strengthen the casing at selected regions, and especially adjacent the foot of the casing. The cross-webbing may include one or more raised portions of the exterior surface of the casing similar to the ribs and extending in a direction perpendicular to the ribs. However, the addition of cross-webbing adds additional weight to the casing while also significantly increasing the complexity of the manufacturing process used to form the casing.

It would therefore be desirable to produce a casing for a heat exchanger that reinforces only selected regions of the casing while also minimizing a quantity of material needed to manufacture the casing.

SUMMARY OF THE INVENTION

Compatible and attuned with the present invention, a casing for a heat exchanger that reinforces only selected regions of the casing while also minimizing a quantity of material needed to manufacture the casing.

In an embodiment of the invention, a tank for a heat exchanger comprises a casing having a hollow interior. A foot of the casing forms an outwardly extending flange around a perimeter of an opening providing access to the hollow interior of the casing. Oppositely arranged walls of the casing each have a corrugated profile adjacent the foot of the casing.

In another embodiment of the invention, a casing for a heat exchanger comprises a foot extending around a perimeter of a header opening providing access to a hollow interior of the casing, wherein the foot includes a first side portion formed opposite a second side portion. A wall extends from the first side portion of the foot to the second side portion in an arcuate shape. A plurality of outwardly projecting ribs is formed in the wall adjacent the foot along each of the first side portion and the second side portion.

BRIEF DESCRIPTION OF THE DRAWINGS

The above, as well as other objects and advantages of the invention, will become readily apparent to those skilled in the art from reading the following detailed description of a preferred embodiment of the invention when considered in the light of the accompanying drawings.

DETAILED DESCRIPTION OF THE INVENTION

The following detailed description and appended drawings describe and illustrate various embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 4:
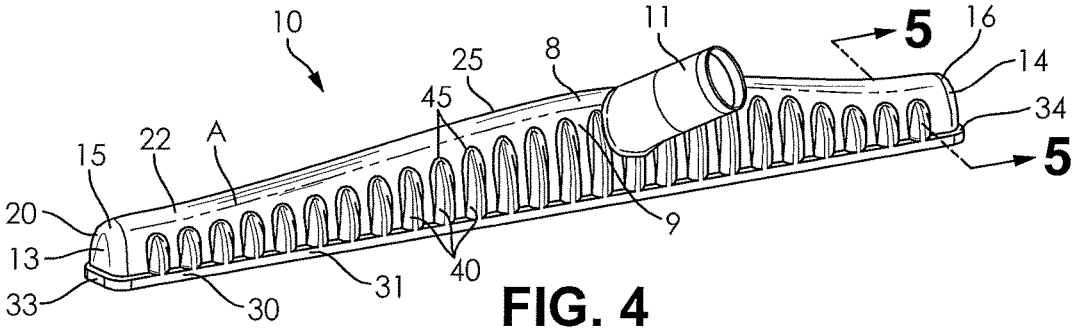
FIG. 4 is a top perspective view of a casing according to an embodiment of the invention.
Figure 5:
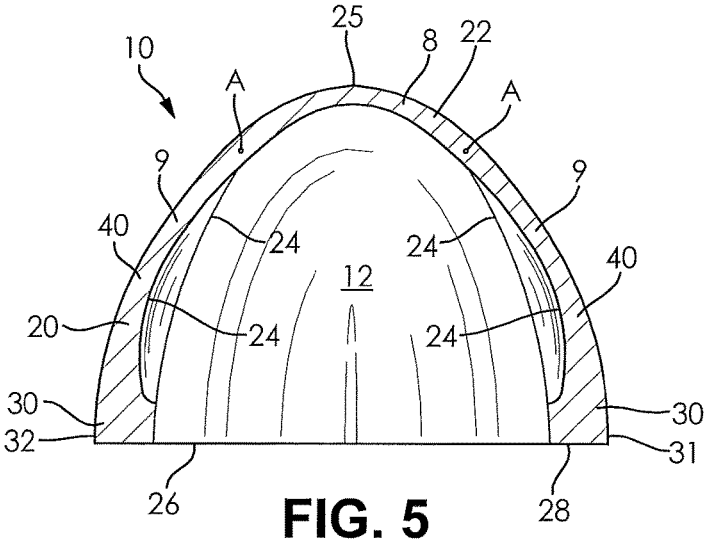
FIG. 5 is an enlarged cross-sectional view of the casing taken along line 5-5 of FIG. 4.
Figure 6:
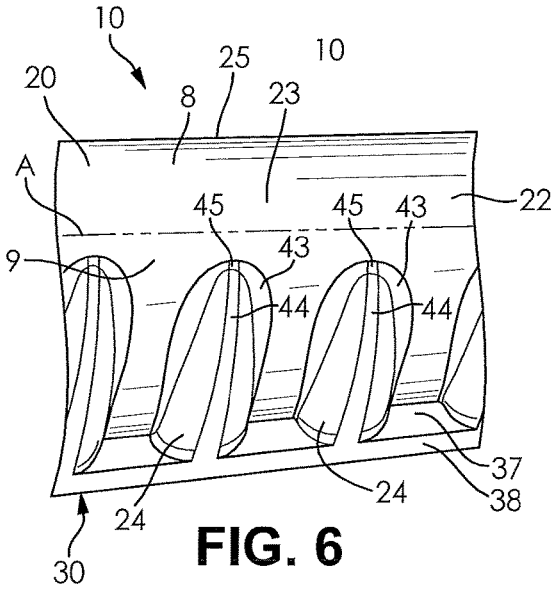
FIG. 6 is an enlarged fragmentary top perspective view of the casing illustrated in FIG. 4.

FIGS. 4-6 illustrate a casing 10 according to an embodiment of the invention. The casing 10 may form a portion of a tank disposed at one end of a heat exchanger (not shown) such as a radiator used in an automobile application. However, the casing 10 may be adapted for use with any suitable form of heat exchanger for use in any application without departing from the scope of the present invention. Typically, such heat exchangers include a pair of the tanks, wherein each of the tanks is disposed at one end of a core of the heat exchanger. The core of the heat exchanger may include a plurality of heat exchanging tubes extending from one of the tanks to the other of the tanks. The casing 10 forms a hollow container of the tank used to either distribute a fluid to each of the heat exchanging tubes or to collect the fluid after having passed through each of the heat exchanging tubes. The casing 10 may be adapted for use with either of an inlet tank or an outlet tank of the heat exchanger.

The casing 10 includes a wall 20 partially enclosing a hollow interior 12 of the casing 10. The wall 20 extends around all sides of the hollow interior 12 with the exception of a substantially planar header opening 26 (illustrated in FIG. 5). The wall 20 comprises a first end portion 13 formed at a first end 15 of the casing 10, a second end portion 14 formed at a second end 16 of the casing 10, an arcuate portion 22 extending from the first end portion 13 to the second end portion 14, and a foot 30 extending around a periphery of the casing 10 adjacent the header opening 26 thereof. An edge 28 (illustrated in FIG. 5) of the wall 20 extends around a perimeter of the header opening 26. The foot 30 of the casing 10 is an outwardly extending flanged portion of the wall 20 formed adjacent the peripheral edge 28. The foot 30 of the casing 10 extends outwardly from the peripheral edge 28 of the wall 20 in a direction substantially parallel to the plane defined by the header opening 26. The foot 30 has a substantially rectangular perimeter shape as it extends around the header opening 26 and includes a first elongate portion 31, a second elongate portion 32 (illustrated in FIG. 5), a first short portion 33, and a second short portion 34. The first elongate portion 31 extends substantially parallel to and is formed opposite the second elongate portion 32 and the first short portion 33 extends substantially parallel to and is formed opposite the second short portion 34. The first short portion 33 is formed at a first end 13 of the casing 10 and the second short portion 34 is formed at a second end 14 of the casing 10. Although described separately, it should be understood that each of the first end portion 13, the second end portion 14, the arcuate portion 22, and the foot 30 may be formed integrally, as desired.

The foot 30 of the casing 10 may be provided for coupling a header (not shown) of the associated tank to the casing 10. The header may include a plurality of openings formed therein for receiving each of the heat exchanger tubes. In some embodiments, a gasket or seal (not shown) is disposed between the header and the foot 30 of the casing 10 to provide a fluid tight seal therebetween. The header may be coupled to a structure such as the ribbon crimp strip 5 illustrated in FIG. 2. The ribbon crimp strip 5 and the associated header may then be crimped to the foot 30 of the casing 10, thereby coupling the header to the casing 10 while compressing the gasket between the header and the foot 30 of the casing 10. A method of coupling the ribbon crimp strip 5 to the casing 1 is described in greater detail hereinbelow.

As best shown in FIGS. 4 and 5, the arcuate portion 22 of the wall 20 has a substantially arcuate cross-sectional shape extending circumferentially from the first elongate portion 31 of the foot 30 to the oppositely arranged second elongate portion 32 of the foot 30. The arcuate cross-sectional shape of the arcuate portion 22 continues along a length of the casing 10 from the first end portion 13 to the second end portion 14 thereof. Accordingly, the arcuate portion 22 of the wall 20 comprises a pair of oppositely arranged segments of the wall 20 meeting at an apex of the arcuate portion 20. The apex of the arcuate portion 22 of the wall 20 forms a spine 25 of the casing 10 opposite the header opening 26 and extending from the first end portion 13 to the second end portion 14. As shown in FIG. 4, the spine 25 may have a curvilinear shape as it extends from the first end portion 13 to the second end portion 14 thereof due to a variable geometry of the casing 10 along its length. Accordingly, the arcuate cross-sectional shape of the arcuate portion 22 may vary along a length of the casing 10. For example, FIG. 4 illustrates the arcuate portion 22 as having a substantially semi-circular cross-sectional shape adjacent each of the first end portion 13 and the second end portion 14 and a substantially semi-elliptical shape elongated in a direction from the header opening 26 toward the spine 25 along portions of the casing 10 intermediate the first end portion 13 and the second end portion 14.

The casing 10 also includes a conduit 11 extending therefrom for supplying or collecting the fluid flowing through the casing 10. If the casing 10 is used as an inlet tank of the heat exchanger, the conduit 11 may act as an inlet into the casing 10. In contrast, if the casing 10 is used as an outlet tank of the heat exchanger, the conduit 11 may act as an outlet out of the casing 10. The conduit 11 may intersect the arcuate portion 22 of the wall 20 adjacent the spine 25 thereof. However, other configurations of the conduit 11 may be used without departing from the scope of the present invention so long as the conduit 11 is positioned to distribute or collect the fluid flowing through the casing 10.

The foot 30 forms a ledge extending around a perimeter of the casing 10 including a first surface 37 and a second surface 38. The first surface 37 may be arranged substantially parallel to the plane of the header opening 26. The first surface 37 intersects the arcuate portion 22 of the wall 20 along each of the first elongate portion 31 and the second elongate portion 32 of the foot 30. As shown in FIGS. 4 and 6, the first surface 37 of the foot 30 may be arranged substantially perpendicular to the arcuate portion 22 of the wall 20 at the intersection therebetween. The second surface 38 extends circumferentially around a perimeter of the foot 30 and may be arranged substantially perpendicular to the first surface 37.

The casing 10 further includes a plurality of ribs 40 projecting from an outer surface 23 of the arcuate portion 22 of the wall 20 thereof. The ribs 40 may only be formed along each of the first side portion 31 and the second side portion 32 of the foot 30, as desired. As best shown in FIG. 6, each of the ribs 40 has a variable shape as each of the ribs 40 extends from the first surface 37 of the foot 30 and toward the spine 25. A height of each of the ribs 40 is defined as an extent that an outer surface 42 of each of the ribs 40 is spaced apart in a perpendicular direction from the outer surface 23 of the arcuate portion 22 along regions of the wall 20 formed between adjacent ones of the ribs 40. In other words, a height of each of the ribs 40 describes how far each of the ribs 40 projects away from the portions of the outer surface 23 of the arcuate portion 22 not having one of the ribs 40 projecting therefrom. A width of each of the ribs 40 is measured in a direction parallel to a longitudinal axis of the casing 10 from one intersection of each of the ribs 40 with the outer surface 23 of the arcuate portion 22 to an oppositely arranged intersection of each of the ribs 40 with the outer surface 23 of the arcuate portion 22. A length of each of the ribs 40 is measured in the circumferential direction of the arcuate portion 22 of the wall 20 from the first surface 37 of the foot 30 toward the spine 25 of the arcuate portion 22.

Each of the ribs 40 includes a rounded portion 24 at a base of each of the ribs 40 intersecting the first surface 37 of the foot 30. The rounded portion 24 may have a cross-sectional shape substantially resembling a segment of a circle, a semi-circle, a parabolic segment, or any other symmetric arcuate shape, as desired. An outermost surface of the rounded portion 24 of each of the ribs 40 having a greatest height relative to the outer surface 23 of the arcuate portion 22 of the wall 20 may be aligned with the second surface 38 of the foot 30. A remainder of the rounded portion 24 curves away from the second surface 38 and toward the arcuate portion 22 of the wall 20 along the first surface 37 of the foot 30.

Figure 2:
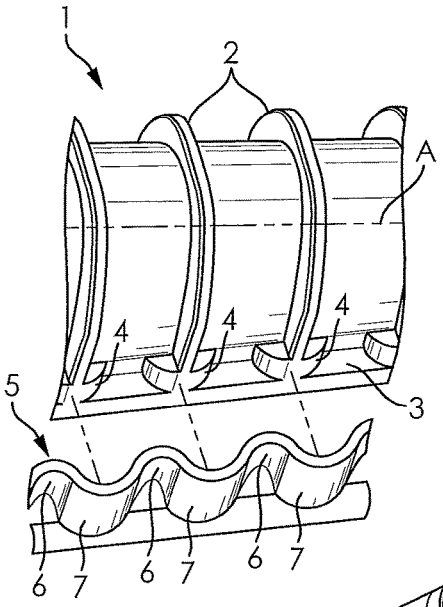
FIG. 2 (PRIOR ART)
FIG. 2 is an enlarged fragmentary top perspective view of a portion of the casing illustrated in FIG. 1 configured to receive a ribbon crimp strip for coupling a header to the casing.

The foot 30 of the casing 10 and the rounded portion 24 of each of the ribs 40 may cooperate to receive the ribbon crimp strip 5 illustrated in FIG. 2 to couple the ribbon crimp strip 5 to the casing 10, thereby coupling an associated header coupled to the ribbon crimp strip 5 to the casing 10. The recessed portions 6 of the ribbon crimp strip 5 are configured to be placed over and on the first surface 37 of the foot 30 while the projecting portions 7 are configured to receive the rounded portion 24 of each of the ribs 40 in order to couple the associated header to the casing 10 by providing an interference fit therebetween. Accordingly, the rounded portion 24 of each of the ribs 40 serves the dual purposes of providing a reinforcing structure of the wall 20 while also providing the casing 10 with a suitable corrugated profile along a length thereof for coupling the corrugated ribbon crimp strip 5 of the header to the casing 10.

As each of the ribs 40 extends along the arcuate portion 22 of the wall 20 and toward the spine 25 in the lengthwise direction of each of the ribs 40, the height of each of the ribs 40 is reduced gradually to form a curvilinear surface of each of the ribs 40. Additionally, as each of the ribs 40 extend in the lengthwise direction toward the spine 25, the width of each of the ribs 40 is also reduced. FIG. 6 illustrates each of the ribs 40 with the use of contour lines showing one example of a transition of each of the ribs 40 to the remainder of the outer surface 23 of the arcuate portion 22 of the wall 20. Accordingly, each of the ribs 40 includes a transition region 43 formed around at least a portion of a perimeter of each of the ribs 40 wherein each of the ribs 40 transitions from a substantially rounded projecting portion 44 to the remainder of the outer surface 23 of the arcuate portion 22 of the wall 20. The transition region 43 ensures that the transition from the arcuate portion 22 of the wall 20 to each of the projecting portions 44 of each of the ribs 40 includes a rounded and curvilinear surface devoid of sharp edges. The elimination of sharp transitional edges reduces the incidence of localized stress risers caused by a sudden change in geometry of the casing 10.

As described with reference to the prior art casings 1, 1' disclosed in FIGS. 1-3, the casing 10 may be subjected to internal pressures caused by the introduction of a fluid during the operation of the heat exchanger having the casing 10. Such internal pressures may form a bending moment within the casing 10 dividing the casing 10 into a compressive portion 8 undergoing compressive stresses and a pair of tensile portions 9 undergoing tensile stresses, wherein the compressive portion 8 is separated from each of the tensile portions 9 by a pair of neutral stress lines A. The neutral stress lines A represents neutral stress portions of the wall 20 wherein stresses are minimized due to the transition from the compressive stresses to the tensile stresses. As shown in FIGS. 4-6, each side of the arcuate portion 22 of the wall 20 of the casing 10 includes one of the neutral stress lines A along a length thereof, wherein the neutral stress lines A are substantially symmetric about the spine 25 of the casing 10. As shown in FIG. 4, a shape and position of each of the neutral stress lines A may be directly related to a shape and form of the spine 25 relative to the foot 30 of the casing 10.

As shown in FIGS. 4 and 6, each of the ribs 40 terminates at a distal end 45 thereof spaced apart from the foot 30 of the casing 10. The length of each of the ribs 40 as measured from the first surface 37 of the foot 30 to the distal end 45 thereof may vary along a length of the casing 10 in accordance with a position of each of the neutral stress lines A. Because the neutral stress lines A represent portions of the wall 20 having a minimized stress, the wall 20 does not require additional reinforcement from the ribs 40 along these portions thereof. As such, each of the ribs 40 terminates at the distal end 45 thereof adjacent one of the neutral stress lines A without crossing over either of the neutral stress lines A.

Accordingly, the wall 20 may be formed to include the ribs 40 only along those portions of the wall 20 undergoing the tensile stresses within the tensile portions 9. In contrast to the prior art casings illustrated in FIGS. 1-3, the casing 10 having the ribs 40 does not require additional reinforcement along the compressive portion 8 of the casing 10 including the spine 25. The elimination of the ribs along these portions of the wall 20 reduces a quantity of material used to form the casing 10 in comparison to the casings 1, 1' of the prior art.

The entirety of the casing 10 including the first end portion 13, the second end portion 14, the arcuate portion 22, the foot 30, and the ribs 40 may be formed integrally in a manufacturing process such as molding. If molding is used, the curvilinear contours and shapes formed between the different features of the casing 10 aid a molding material in properly filling each portion of an associated mold due to the lack of sharp edges and corners, which under some circumstances resist a timely introduction of the molding material. Accordingly, a molding process used to form the casing 10 may be accomplished in less time in comparison to a molding process of one of the casings of the prior art such as those illustrated in FIGS. 1-3.

Additionally, with renewed reference to FIG. 5, an inner surface 24 of the wall 20 may be cored out along those portions of the inner surface 24 corresponding to the ribs 40, thereby allowing the inner surface 24 of the wall 20 to be indented relative to those portions of the wall 20 devoid of the ribs 40. FIG. 5 illustrates this relationship by showing the inner surface 24 corresponding to a pair of the ribs 40 in comparison to the inner surface 24 formed along the arcuate portion 22 devoid of the ribs 40. Accordingly, the wall 20 of the casing 10 may be formed to have a substantially equal thickness along both the arcuate portions 22 of the wall 20 devoid of the ribs 40 as well as along the ribs 40. The coring out of the inner surface 24 of the wall 20 advantageously minimizes an amount of material used to form the casing 10 while also minimizing a mass of the casing 10.

Figure 7:
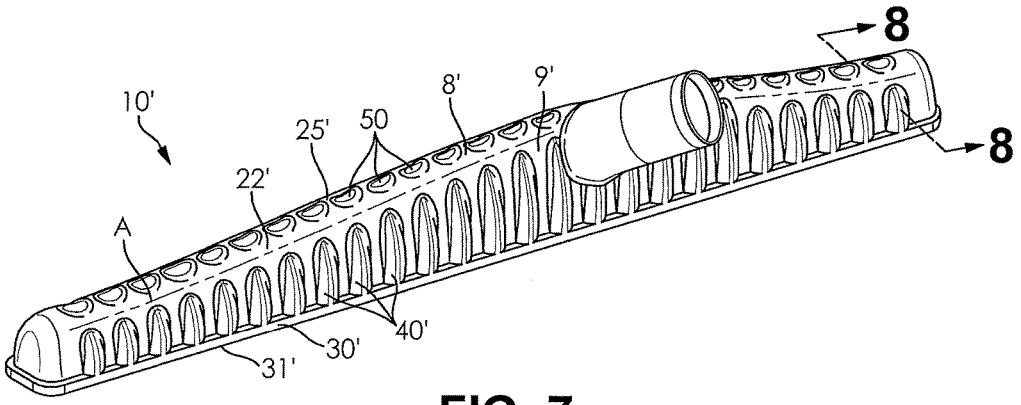
FIG. 7 is a top perspective view of a casing according to another embodiment of the invention.
Figure 8:
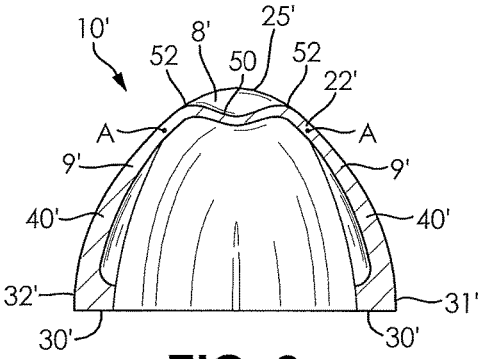
FIG. 8 is an enlarged cross-sectional view of the casing taken along line 8-8 of FIG. 7.
Figure 9:
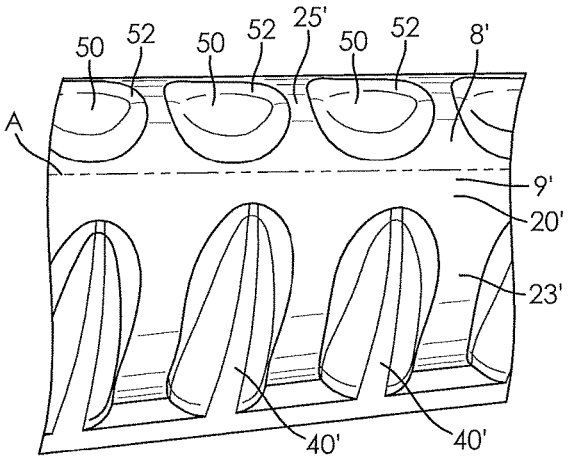
FIG. 9 is an enlarged fragmentary top perspective view of the casing illustrated in FIG. 7.

FIGS. 7-9 illustrate a casing 10' according to another embodiment of the invention. Structure similar to that illustrated in FIGS. 4-6 includes the same reference numeral and a prime (') symbol for clarity. The casing 10' is substantially identical to the casing 10 illustrated in FIGS. 4-6 with the exception of the arcuate portion 22' of the wall 20' including a plurality of depressions 50 formed along the spine 25' of the casing 10'.

Each of the depressions 50 may be aligned with a corresponding pair of the ribs 40' in the longitudinal direction of the casing 10'. Each of the depressions 50 may have a substantially circular or elliptical perimeter shape, causing each of the depressions 50 to have a contour resembling that of a saddle. Each of the depressions 50 includes a transition region 52 formed around a perimeter thereof. The transition region 52 is a portion of the wall 20 transitioning from the entirely arcuate portion 22 of the wall 20 to the downwardly sloped portion of each of the depressions 50. Accordingly, each of the transition regions 52 of each of the depressions 50 allows for the outer surface 23' of the wall 20' to be formed without any sharp or sudden changes in geometry that tend to lead to increased localized stresses within the casing 10'. The depressions 50 cause the spine 25' of the casing 10' to have a corrugated profile along a length thereof.

As discussed hereinabove, a bending moment formed within the casing 10' may cause the spine 25' to be under compressive stresses within the compression portion 8' of the casing 10'. Accordingly, the depressions 50 are included in the casing 10' to reinforce the spine 25' thereof as the curved surfaces forming each of the depressions 50 tend to resist deflections caused by compressive stresses encountered within the compression portion 8'.

The inclusion of the ribs 40' formed along each of the first elongate portion 31' and the second elongate portion 32' of the foot 30' as well as the depressions 50 formed along the spine 25' causes the casing 10' to have a corrugated shape along at least three distinct portions of the casing 10' separated from each other by the neutral stress lines A. Accordingly, each portion of the casing 10' undergoing one of a compressive stress or a tensile stress is adequately reinforced along these regions while those portions of the casing 10' undergoing a minimal amount of stress maintain the arcuate shape of the wall 20'. Accordingly, the corrugated profile of the wall 20' immediately adjacent the foot 30' transitions to a curvilinear profile of the wall 20' along each of the neutral stress lines A. Similarly, the corrugated profile of the wall 20' along the spine 25' also transitions to the curvilinear profile of the wall 20' along each of the neutral stress lines A. The corrugated profile of the ribs 40' formed adjacent the foot 30' of the casing 10' also allows the casing 10' to be coupled to one of the ribbon crimp strips 5 illustrated in FIG. 2. Accordingly, the ribs 40' serve the dual functions of forming a surface for crimping a header to the casing 10' while also addressing the problem of localized stress risers formed in the casing 10' adjacent the foot 30' thereof.

Figure 10:
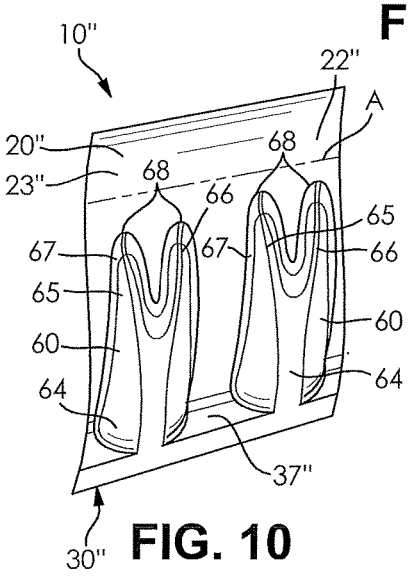
FIG. 10 is an enlarged fragmentary top perspective view of a casing according to another embodiment of the invention.

FIG. 10 illustrates a portion of a casing 10" according to another embodiment of the invention. Structure similar to that illustrated in FIGS. 4-6 includes the same reference numeral and a double prime (") symbol for clarity. The casing 10" is identical to the casing 10 illustrated in FIGS. 4-6, except the casing 10" includes a plurality of ribs 60 formed thereon in place of the ribs 40 of the casing 10. Each of the ribs 60 includes a rounded portion 64 having a shape and size suitable for receiving the projecting portions 7 of the ribbon crimp strip 5 illustrated in FIG. 2. The rounded portion 64 of each of the ribs 60 is disposed on the first surface 37" of the foot 30" and has an arcuate profile that may most closely resemble a segment of a circle, a semi-circle, a parabolic segment, or any other form of symmetric arcuate shape. The rounded portion 64 of each of the ribs 60 may be spaced apart from the rounded portion 64 of an adjacent one of the ribs 60 along the foot 30" of the casing 10" to receive each of the recessed portions 6 of the ribbon crimp strip 5 illustrated in FIG. 2 therebetween to facilitate crimping the ribbon crimp strip 5 to the foot 30".

The rounded portion 64 of each of the ribs 60 extends in the lengthwise direction of each of the ribs 60 until each of the ribs 60 divides into a first extension 65 and a second extension 66. A central portion of each of the ribs 60 formed at an apex of the rounded portion 64 thereof reduces in height as each of the ribs 60 is divided into the first extension 65 and the second extension 66 until the central portion merges into the remainder of the outer surface 23" of the arcuate portion 22" of the wall 20". The first extension 65 and the second extension 66 each have a substantially arcuate cross-sectional shape, causing each of the extensions 65, 66 to have a shape substantially similar to the shape of each of the ribs 40 illustrated in FIGS. 4-6. Each of the ribs 60 includes a transition region 67 formed around a perimeter thereof wherein each of the ribs 60 transitions to the remainder of the outer surface 23" of the arcuate portion 22" of the wall 20", thereby eliminating the formation of sharp edges or corners on the outer surface 23" of the wall 20".

The ribs 60 are configured to reinforce the casing 10" within each of the tensile portions 9" thereof formed between each of the neutral stress lines A and the foot 30" of the casing 10". Accordingly, a distal end 68 of each of the first extension 65 and the second extension 66 may be formed adjacent one of the neutral stress lines A without crossing over the neutral stress line A.

Although not pictured in FIG. 10, it should be understood that the casing 10" may also be formed with a plurality of depressions formed along a spine thereof and in longitudinal alignment with each subsequent pair of the ribs 60, wherein each of the depressions in similar in form to the depressions 50 illustrated in FIGS. 7-9.

The ribs 60 beneficially serve the dual purposes of providing a corrugated surface adjacent the foot 30" of the casing 10" for crimping the ribbon crimp strip 5 thereto and reinforcing the casing 10" within the tensile portions 9" thereof. The separation of the rounded portion 64 of each of the ribs 60 into a first extension 65 and a second extension 66 causes an array of the ribs 60 to have twice as many corrugations as an array of the ribs 40, thereby further reinforcing the casing 10" against deflections caused by the bending moment formed therein during use thereof.

EXAMPLE

Figure 1:
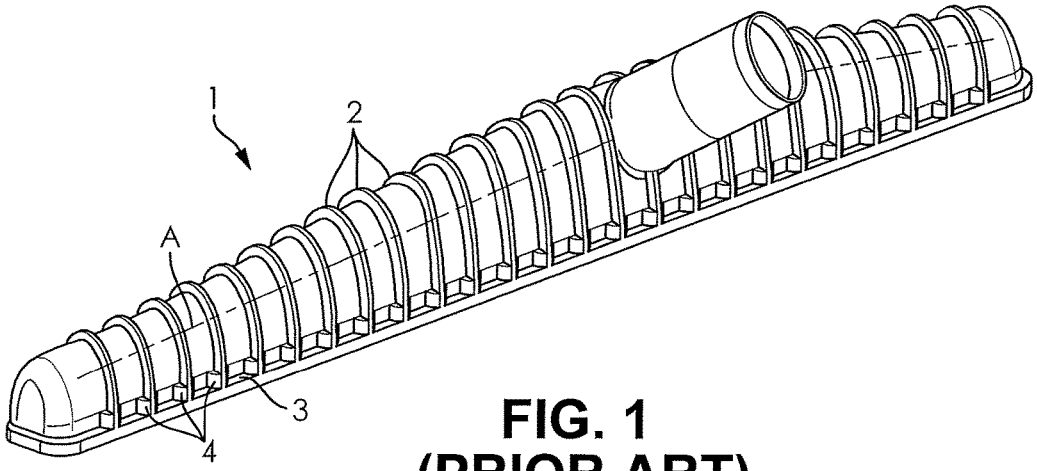
FIG. 1 (PRIOR ART)
FIG. 1 is a top perspective view of a casing according to the prior art having ribs formed along a length thereof.
Figure 3:
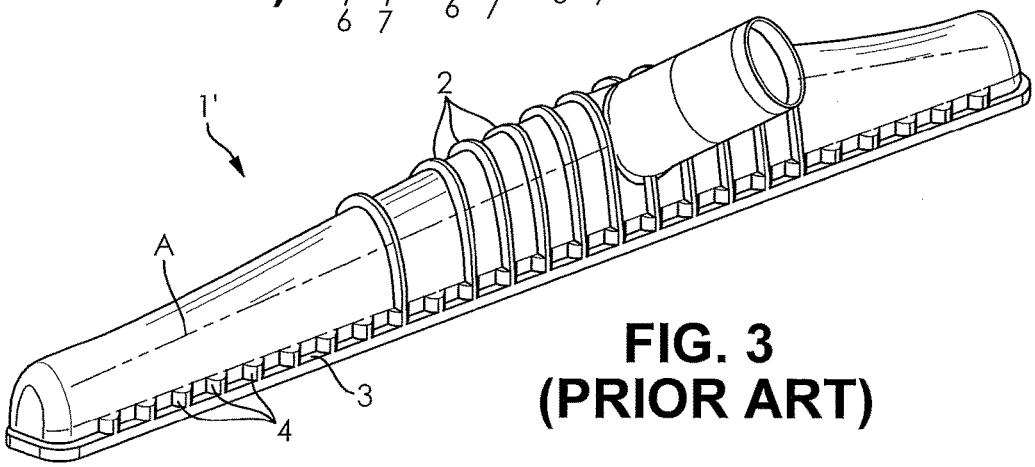
FIG. 3 (PRIOR ART)
FIG. 3 is a top perspective view of a casing according to the prior art having ribs formed only along regions of the casing in need of additional reinforcement.

Table 1 illustrates the results of Finite Element Analysis (FEA) performed using computer models of each of the casing 1 illustrated in FIG. 1 having the ribs 2 formed along a length thereof, the casing 1' illustrated in FIG. 3 having the ribs 2 formed at select regions in need of reinforcement, the casing 10 illustrated in FIG. 4 having the ribs 40, and the casing 10' illustrated in FIG. 7 having both the ribs 40' and the depressions 50. The FEA was performed wherein an internal pressure applied to an interior of each of the casings 1, 1', 10, 10' was assumed to be 225 kPa. The FEA established a maximum stress and a maximum deflection encountered within each of the casings 1, 1', 10, 10' when being exposed to the internal pressure. Table 1 also illustrates a mass of each of each of the respective casings 1, 1', 10, 10' for comparison.

TABLE 1

| | Mass (g) | Maximum Stress (MPa) | Maximum Deflection (mm) |
|---|---|---|---|
| Casing 1 illustrated in FIG. 1 | 184 | 26.5 | 1.14 |
| Casing 1' illustrated in FIG. 3 | 170 | 29.8 | 1.15 |
| Casing 10 illustrated in FIG. 4 | 169 | 13.6 | 0.58 |
| Casing 10' illustrated in FIG. 7 | 169 | 13.1 | 0.56 |

As indicated in Table 1, the casings 10, 10' of the present invention have several advantageous qualities when compared to the casings 1, 1' of the prior art illustrated in FIGS. 1 and 3, respectively.

For example, in comparison to the fully ribbed casing 1 illustrated in FIG. 1, the casing 10 having the ribs 40 illustrated in FIG. 4 has a mass that is reduced by about 8%, a maximum stress that is reduced by about 49%, and a maximum deflection that is reduced by about 49%. Similarly, in comparison to the casing 1' illustrated in FIG. 3 having the optimized placement of the ribs 2, the casing 10 illustrated in FIG. 4 has a maximum stress that is reduced by about 54% and a maximum deflection that is reduced by about 50%.

Furthermore, in comparison to the fully ribbed casing 1 illustrated in FIG. 1, the casing 10' illustrated in FIG. 7 having both the ribs 40' and the depressions 50 has a mass that is reduced by about 8%, a maximum stress that is reduced by about 51%, and a maximum deflection that is reduced by about 51%. Similarly, in comparison to the casing 1' illustrated in FIG. 3 having the optimized placement of the ribs 2, the casing 10' illustrated in FIG. 7 has a maximum stress that is reduced by about 56% and a maximum deflection that is reduced by about 51%.

Accordingly, each of the casings 10, 10' of the present invention advantageously have a reduced mass, maximum stress, and maximum deflection in comparison to the casing 1 illustrated in FIG. 1 having the ribs 2 formed uniformly along a length thereof. Additionally, the casings 10, 10' of the present invention also advantageously have a reduced maximum stress and maximum deflection in comparison to the casing 1' illustrated in FIG. 3 having the optimized placement of the ribs 2, while still maintaining substantially the same mass.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A tank for a heat exchanger, the tank comprising:

a casing including a hollow interior, a foot of the casing forming an outwardly extending flange around a perimeter of an opening providing access to the hollow interior, wherein oppositely arranged walls of the casing meet at a spine of the casing and wherein each of the oppositely arranged walls includes a neutral stress portion formed between the foot of the casing and the spine of the casing, wherein the neutral stress portion is a portion of each of the oppositely arranged walls subjected to a minimal stress when a fluid disposed within the casing applies an internal pressure to the casing, wherein each of the oppositely arranged walls includes a plurality of outwardly projecting ribs formed in an outer surface thereof to form a corrugated profile in each of the oppositely arranged walls adjacent the foot of the casing with each of the ribs terminating at a distal end thereof spaced from the foot, and wherein each of the oppositely arranged walls transitions from the corrugated profile adjacent the foot of the casing to a substantially linear profile along the corresponding neutral stress portion.

2. The tank of claim 1, wherein a portion of the spine of the casing has a corrugated profile.

3. The tank of claim 2, wherein a plurality of depressions form the corrugated profile in the spine, and each depression formed in the corrugated profile of the spine is aligned with a corresponding outwardly projecting portion of the corrugated profile of each of the oppositely arranged walls of the casing adjacent the foot in a direction perpendicular to a longitudinal axis of the casing.

4. The tank of claim 1, wherein each of the ribs includes a rounded portion having a substantially arcuate profile formed at an intersection of one of the ribs with the foot of the casing.

5. The tank of claim 4, wherein the rounded portion of each of the ribs is configured to cooperate with an outwardly projecting portion of a ribbon crimp strip, the ribbon crimp strip configured to couple the casing to a header of the heat exchanger.

6. The tank of claim 5, wherein a portion of the foot formed between adjacent ones of the rounded portions is configured to receive an inwardly recessed portion of the ribbon crimp strip to form an interference fit between the foot and the ribbon crimp strip.

7. The tank of claim 4, wherein the rounded portion of each of the ribs divides the rib into a first rib extension extending away from the foot of the casing and a second rib extension extending away from the foot of the casing.

8. The tank of claim 1, wherein each of the oppositely arranged walls transitions from a corrugated profile along the spine of the casing to the linear profile formed along each of the corresponding neutral stress portions.

9. A casing for a tank of a heat exchanger, the casing comprising:

a foot extending around a perimeter of a header opening providing access to a hollow interior of the casing, the foot including a first side portion formed opposite a second side portion;

a wall extending from the first side portion of the foot to the second side portion in an arcuate shape, wherein an apex of the arcuate shape of the wall forms a spine of the wall; and a plurality of outwardly projecting ribs formed in the wall adjacent the foot along each of the first side portion and the second side portion to form a corrugated profile in the wall adjacent the foot, wherein each of the ribs terminates at a distal end thereof spaced from the foot, wherein the wall includes a first neutral stress portion formed between the first side portion of the foot and the spine and a second neutral stress portion formed between the second side portion of the foot and the spine, wherein the first neutral stress portion and the second neutral stress portion each form a portion of the wall subjected to minimal stress when a fluid disposed within the casing applies an internal pressure to the wall, and wherein the wall transitions from the corrugated profile adjacent the foot of the casing to a substantially linear profile along each of the first neutral stress portion and the second neutral stress portion.

10. The casing of claim 9, wherein each of the ribs includes a rounded portion having an arcuate profile formed at an intersection of each of the ribs with the foot.

11. The casing of claim 10, wherein the rounded portion of each of the ribs is configured to cooperate with an outwardly projecting portion of a ribbon crimp strip, the ribbon crimp strip configured to couple the casing to a header of the heat exchanger.

12. The casing of claim 9, wherein the spine includes a plurality of depressions formed therein.

13. The casing of claim 12, wherein each of the depressions formed in the spine is aligned with a pair of the outwardly projecting ribs with respect to a longitudinal direction of the wall.

14. The casing of claim 12, wherein each of the ribs formed along the first side portion extends between the first side portion and the first neutral stress portion, wherein each of the ribs formed along the second side portion extends between the second side portion and the second neutral stress portion, and wherein each of the depressions is formed between the first neutral stress portion and the second neutral stress portion.

15. The casing of claim 12, wherein each of the depressions is substantially saddle shaped.

16. The casing of claim 9, wherein a width of each of the ribs and an extent each of the ribs projects outwardly from the wall are decreased as each of the ribs extends from the foot toward an apex of the arcuate shape of the wall.

17. The casing of claim 9, wherein each of the ribs includes a transition region formed around a portion of a perimeter thereof, the transition region forming a smooth curvilinear surface connecting a projecting portion of each of the ribs to a portion of the wall surrounding each respective one of the ribs.

* * * * *